United States Patent [19]

Soroka

[11] 4,091,437

[45] May 23, 1978

[54] FREE PLAY APPARATUS FOR COIN OPERATED AMUSEMENT DEVICES

[76] Inventor: Walter Soroka, 5350 Virginia Dr., Youngstown, Ohio 44515

[21] Appl. No.: 731,727

[22] Filed: Oct. 12, 1976

[51] Int. Cl.[2] ..... H01H 47/00

[52] U.S. Cl. ..... 361/166; 194/15; 340/309.3; 340/309.4; 340/162

[58] Field of Search ..... 361/166; 340/309.1, 340/309.3, 309.4, 309.5, 309.6, 319, 162; 194/1 R, 15, DIG. 11, DIG. 18

[56] References Cited

U.S. PATENT DOCUMENTS

| | | | |
|---|---|---|---|
| 3,147,346 | 9/1964 | Herman | 340/162 |
| 3,202,255 | 8/1965 | Kenney et al. | 340/162 |
| 3,266,610 | 8/1966 | Stahl | 194/15 |
| 3,988,727 | 10/1976 | Scott | 340/309.4 |

*Primary Examiner*—Gerald Goldberg
*Attorney, Agent, or Firm*—H. Gordon Shields

[57] ABSTRACT

Apparatus is disclosed which automatically times non-play time for coin operated amusement devices and provides a predetermined period when the device may be actuated to provide a free play.

7 Claims, 1 Drawing Figure

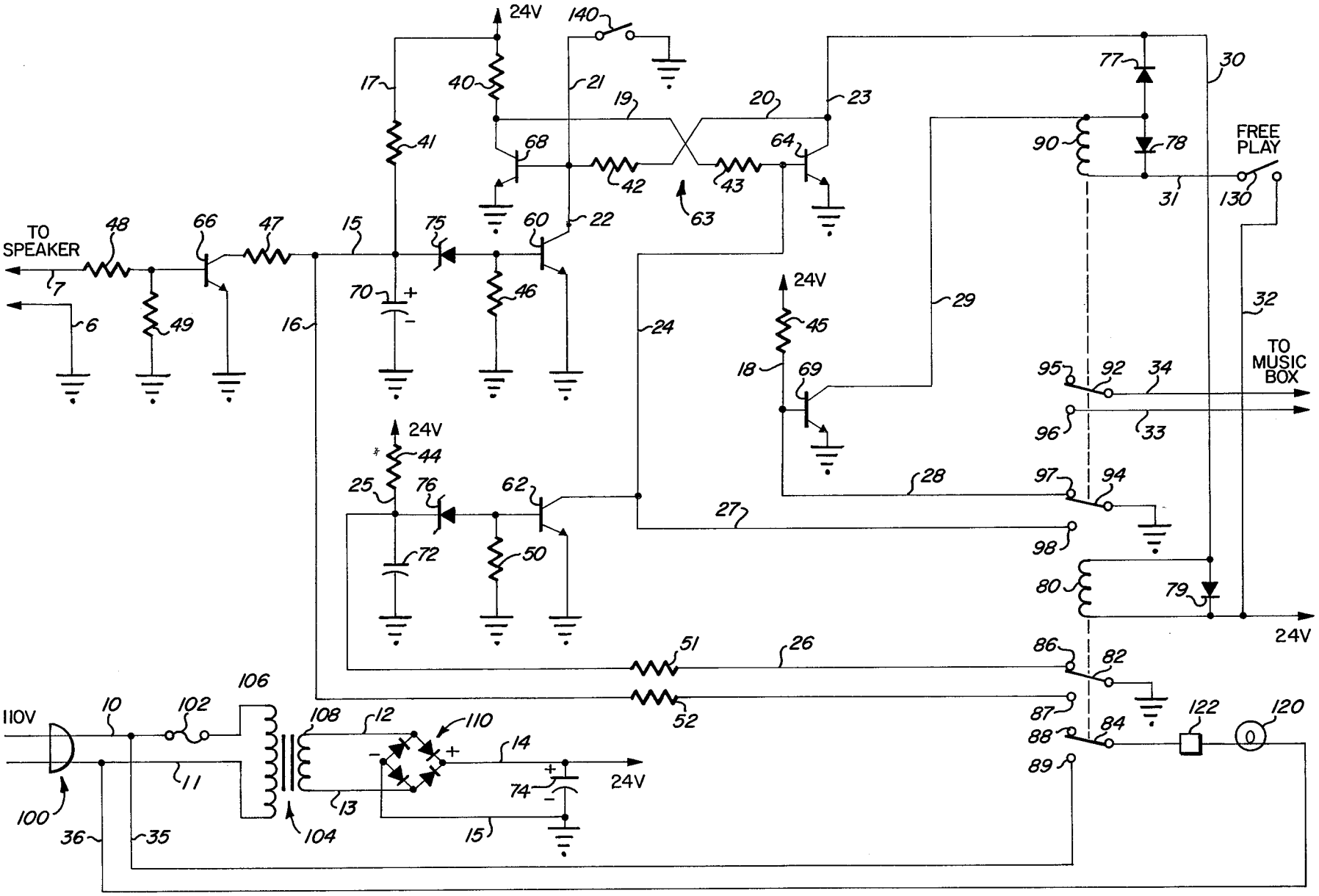
FREE PLAY
TO MUSIC BOX
24V
TO SPEAKER
110V

FREE PLAY APPARATUS FOR COIN OPERATED AMUSEMENT DEVICES

BACKGROUND OF THE INVENTION

1. Field of the Invention

This invention relates to coin operated amusement devices, and, more particularly, to apparatus for providing free play of the device in response to a certain time delay after actuation of the device.

2. Description of the Prior Art

Coin operated entertainment and amusement apparatus serve business entities in two primary respects. The first respect is that they provide additional revenue to the proprietor of the establishment in which they are located in addition to the revenue for which the establishment is primarily operated, such as the sale of food and/or beverages. In the second respect, such apparatus provide entertainment for customers or clients of the establishments in which they are located. A third benefit, which, while not directly related to the first two named benefits, and perhaps not directly related to the two primary purposes, is the function of advertising. In some devices, advertising space on the device is illuminated during the time in which the device is in operation. Obviously, the more the device is in operation, the more entertainment is provided and the more revenue is derived from the operation of the device.

For the reasons given in the preceding paragraph, it is to the advantage of the proprietor of the establishment in which the coin operated device is installed to encourage maximum time utilization of the device. That is, the proprietor of the establishment benefits from the revenue generated by the device while the device is in use, and the customers of the establishment benefit by the entertainment provided by the device. It is therefore desirable to encourage customers to use the coin operated devices as much as possible.

One way in which use of a device may be encouraged is to provide, under certain circumstances, a free play. The free play occurs under certain circumstances, usually dependent upon a predetermined time interval or period after the latest, or last, use of the device. After a predetermined period of time has elapsed since the device was used, an opportunity is presented for a so-called free play of the device.

Such free play apparatus is described and claimed in U.S. Pat. No. 3,266,610, patented Aug. 16, 1966. The apparatus described in U.S. Pat. No. 3,266,610 comprises electromechanical apparatus for providing a free play of a coin operated machine. The apparatus comprises a plurality of relays controlled by an electromechanical timer. The actuation or energizing of the relays is accomplished in accordance with predetermined time periods controlled by the timer. The timer includes various contacts which are made and broken in response to the predetermined time periods and in turn provide for the energization and de-energization of the various relays.

The use of such electromechanical apparatus, using a plurality of relays, is subject to the well-known and well-understood problems of cost, size, and mechanical wear with the attendant problem of potential failure.

The apparatus of the present invention comprises solid state circuitry which substantially eliminates the problems of the prior art, as enumerated in the preceding paragraph. The present invention accordingly may be made smaller, less expensive, and more reliable, due to the use of such solid state electronic components and elements.

SUMMARY OF THE INVENTION

The apparatus described and claimed herein comprises electronic apparatus for providing free play for a coin operated device after a predetermined time elapses after the device has been used and provides such free play opportunity for only a single free play and for only a limited period of time. The apparatus includes a bistable multivibrator or flip-flop which controls the period of wait after use and the period of free play opportunity. The period in which the flip-flop stays in its respective stable state is in turn controlled by a pair of timing circuits, one of which may be varied or cancelled by a user exercising the opportunity for a free play.

Among the objects of the present invention are the following:

To provide new and useful free play apparatus for coin operated amusement devices;

To provide new and useful apparatus for providing a limited time of free play for coin operated amusement devices;

To provide new and useful free play apparatus for coin operated amusement devices which is compact, inexpensive, and reliable;

To provide new and useful circuit apparatus for providing a selective period of free play for a coin operated amusement device;

To provide new and useful circuit apparatus including a bistable flip-flop for controlling time periods for actuating coin operated amusement apparatus; and To provide new and useful circuit apparatus including a pair of capacitors to control the turning on of transistors for determining the stable states of a bistable multivibrator.

BRIEF DESCRIPTION OF THE DRAWING

The sole FIGURE is a schematic circuit diagram of apparatus of the present invention.

DESCRIPTION OF THE PREFERRED EMBODIMENT

The sole FIGURE is a schematic circuit diagram of the apparatus of the present invention which comprises free play apparatus for coin operated amusement devices which includes a limited time period after the coin operated amusement device has been used in which a customer may select a "free play." For example, after a coin operated device, such as a music box, is operated by the proper or appropriate insertion of a coin in a typical, well-known manner, the apparatus of the present invention waits or counts a period of time after such operation, and at the conclusion of such waiting time period, which is a predetermined time corresponding to the charging time for a capacitor, as will be discussed in detail below, a bistable multivibrator changes states to begin determining or counting a second, also predetermined, time period in which the apparatus may be actuated to provide a free play for the music box or amusement device. If such free play is not accomplished during the second predetermined time period, another capacitor charges to allow a transistor to conduct, which results in the change of state of the multivibrator and the first time period is once again begun.

To determine when the music box or other coin operated apparatus is in use, the apparatus of the present invention is connected to a convenient speaker within the device. If the device is in operation, a current from the speaker is used to turn on a transistor which insures that the capacitor remains in a discharged state. In the sole FIGURE the free play apparatus is generally designated or denoted by reference numeral 2, and the various components, as they are discussed and referred to, will be given other reference numerals. The schematic diagram includes conventional symbols for the various electronic elements. Two pairs of conductors extend from the apparatus to the coin operated device with which the apparatus is used. Two of the conductors, comprising conductors 6 and 7, are attached to the terminals or conductors of a convenient speaker. Conductor 6 extends from the speaker to a circuit ground, while conductor 7 extends through a resistor 48 to the base of a transistor 66. It will be noted that in the embodiment of the apparatus disclosed herein, all transistors are of the NPN type. Conductor 7 is also terminated to ground between resistor 48 and transistor 66 through a resistor 49. The emitter of transistor 66 is grounded, while the collector of transistor 66 is connected through a resistor 47 to a pair of conductors 15 and 16.

A pair of transistors 64 and 68 are connected together in a well-known configuration of a bistable multivibrator or flip-flop 63. The base of transistor 64 is connected by a conductor 19 to the collector of transistor 68, with a resistor 43 between the base and the collector and connected to the conductor 19. Similarly, the base of transistor 68 is connected to the collector of transistor 64 by a conductor 20 and through a resistor 42. The base of transistor 68 is connected through a conductor 21 through a manually operated switch 140 and through a conductor 22 to the collector of a transistor 60. The emitters of both transistors 64 and 68 are grounded to a circuit ground.

Power for the apparatus is derived from ordinary 110 volt line source, through a plug 110. From the plug 100, a pair of conductors 10 and 11 extends to a step-down transformer 104. The conductor 10 from the plug 100 includes an in-line fuse 102. The conductors 10 and 11 connect with a primary coil 106 in the transformer 104. Another pair of conductors 12 and 13 extends from a secondary coil 108 of the transformer 104 to a full wave bridge rectifier 110. The rectifier 110 is of a well-known configuration, including four diodes, to provide rectified direct current voltage. The ratio of turns between the primary 106 and the secondary 108 of the transformer 104 provides for 24 volts from the secondary. From the rectifier, a pair of connectors 14 and 15 extends to the apparatus to provide 24 volts as desired. A capacitor 74 is placed across the 24 volt source connectors 14 and 15 in a well-known manner. The connector 15 extends to a circuit ground. The 24 volt conductor 14 will be connected to several parts of the circuitry, as described in detail below.

Another pair of conductors 35 and 36 extends from the conductors 10 and 11 of the plug 100 to provide the full line voltage of 110 volts of alternating current to a lamp 120. The lamp 120 is in the "on" position, or illuminated, and flashing through a flasher 122 when the apparatus is available for a free play. In a typical use environment, the lamp 120 may be used to illuminate some type of advertising or other indication that the apparatus is in the free play mode and accordingly a free play of music may be selected during the time the lamp is illuminated and flashing.

The flip-flop comprising the transistors 64 and 68 is connected to the 24 volt direct current source through a resistor 40 to the collector of transistor 68 and to the base of transistor 64 by conductor 19 and resistor 43. The 24 volt source is also connected to conductor 17, which extends to conductor 15, and from conductor 15 to the collector of transistor 60 through the resistor 47 and to conductor 16 from conductor 15. Conductors 15 and 17 are also connected to a capacitor 70. A resistor 41 is disposed in conductor 17 between the 24 volt source and conductor 16 and the capacitor 70.

A zener diode 75 is also connected to the 24 volt source through conductor 17 and the resistor 41. The anode of zener diode 75 is connected to the base of transistor 60. The collector of transistor 60 is connected by a conductor 22 to the base of transistor 68 of the flip-flop. The emitter of transistor 60 is grounded. The cathode of the zener diode is connected to the conductors 15 and 17 and to the capacitor 70.

A resistor 46 extends from between the anode of zener diode 75 and the base of transistor 60 to a circuit ground.

The conductor 23 extends from the collector of transistor 64 to the juncture of a conductor 30 and the cathode of a diode 77. The conductor 30 is connected through a diode 79 to the 24 volt source. A relay coil 80 is connected in parallel with the diode 79 on the conductor 23.

Associated with the relay coil 80, and actuated therewith, are a pair of armatures 82 and 84. Armature 82 is connected to a circuit ground on one end, and is movable between a pair of relay contacts 86 and 87. Relay contact 86 is connected to a conductor 26, and relay contact 87 is connected to conductor 16. A pair of resistors 51 and 52 are connected in the conductors 26 and 16, respectively. In the FIGURE, the armature 82 is shown connected to the relay contact 86, which connects the conductors 26 to ground.

The armature 84 connected to conductor 35, is movable between a pair of contacts 88 and 89, and is shown connected to relay contact 88, which opens the circuit from the 110 volt line source through the plug 100 and through the lamp 120 and flasher 122 on conductor 36. The relay contact 89 is connected to conductor 35.

Relay contact 86 is connected through conductor 26 to the cathode of a zener diode 76, to the 24 volt source through a resistor 44 and a conductor 25, and to a capacitor 72. The capacitor 72 is also grounded. The anode of the zener diode 76 is connected to ground through a resistor 50 and is also connected to the base of a transistor 62. The emitter of the transistor 62 is connected to ground, while the collector of the transistor extends to a pair of conductors 24 and 27. The conductor 27 extends to a relay contact 98 and the conductor 24 extends to the base of a transistor 64 of the flip-flop 63.

The relay contact 98 is one of a pair of relay contacts 97 and 98 associated with a relay armature 94 actuated by relay coil 90. The armature 94 is grounded. The relay contact 97 extends to the base of the transistor 69. The base of the transistor 69 is connected to the 24 volt source through a resistor 45, while its emitter is grounded. The collector of the transistor 69 is connected by a conductor 29 to a relay coil 90. The relay coil 90 is also connected by a conductor 31 to a free play switch 130. The relay coil 90 and conductor 29 are also connected to the anodes of a pair of diodes 77 and 78. The cathode of diode 78 is connected to the conductor 31, and the cathode of diode 77 is connected to the juncture of conductors 23 and 30. Diode 77 polarizes the current flow through the coil 90 and diode 78 is across the coil to dampen the inductive back e.m.f. generated when the current flow in an inductor (the relay coil 90) is switched off. Diode 79 performs a similar function for relay coil 80.

The relay coil 90 includes an armature 92 and an armature 94. As indicated, the armature 94 is alternately connected to the relay contacts 97 and 98, and the armature 92 is alternately connected to a pair of relay contacts 95 and 96. In the FIGURE, the armature 92 is shown connected to the contact 95, and the armature 94 is shown connected to contact 97. Armature 92 is connected to a conductor 34 and the relay contact 96 is connected to a conductor 33. The conductors 33 and 34 are in turn connected to a music box. Accordingly, when the armature 92 is connected to the relay contact 96 through the energizing of the coil 90, a circuit comprising conductor 33, contact 96, armature 92, and conductor 34 extends to the music box or other amusement device to provide a free play. The conductors are connected to a maintenance switch which is typically used in music boxes and other amusement devices to provide a free play without the necessity of putting coins in the device.

When the armature 94 is connected to the relay contact 98, the grounded armature is accordingly connected through conductor 27 to the collector of transistor 62 and through conductor 24 to the base of transistor 64.

The flip-flop 63 is in one of two stable states at any one time. One of the stable states may be referred to as the "wait position" of the apparatus and the other stable state may be referred to as the "opportunity position" of the apparatus. The wait position is the time period in which a free play opportunity is not available, while the opportunity position is the time period in which a free play opportunity is available. The opportunity time period is signified by the flashing of lamp 120.

If the music box is being used, a current from a speaker of the music box will be detected on conductors 6 and 7 which will turn on the transistor 66, allowing the transistor to conduct. Accordingly, the capacitor 70 will discharge to ground. While the music box is in operation, the lamp 120 will not be flashing.

When the music box is not being played, no current will be detected on conductors 6 and 7 and transistor 66 will accordingly be turned off. When the transistor 66 turns off, the capacitor 70 starts to charge and the beginning of the wait position or time period begins. The wait position or time period is that period of time required for capacitor 70 to charge to the zener voltage of zener diode 75 through resistor 41 on conductor 17 and is accordingly determined by the time period of the capacitor 70. When the capacitor 70 charges to the zener voltage, transistor 60 turns on. When the transistor 60 turns on, the base of transistor 68 drops to near ground potential on conductor 22 and transistor 68 accordingly turns off. When transistor 68 turns off, the flip-flop 63 changes states and goes to its second stable state and the apparatus switches to the opportunity position. The turning off of transistor 68 is the beginning of the opportunity time period in which a free play is available.

With transistor 68 in the off or nonconducting position, sufficient current is available through resistors 40 and 43 to turn on transistor 64 of the flip-flop 63. With transistor 64 in the on or conducting state, relay coil 80 is energized, which moves armatures 82 and 84 into electrical contact with switch contacts 87 and 89, respectively. When armature 84 is in electrical contact with switch contact 89, the circuit between the 110 volt line on conductors 10 and 11 of the plug 100 through conductors 35 and 36 is completed to allow lamp 120 to flash. The flashing of the lamp 120 indicates that the apparatus is in the opportunity position during which time a free play is available.

When the armature 82 is electrically connected to relay contact 87, conductor 16 is grounded and the capacitor 70 discharges.

If the free play button 130 is manually actuated, the relay coil 90 is actuated, moving the armatures 92 and 94. Armature 92 is moved into electrical contact with relay contact 96, thus completing a circuit to the music box through conductors 33 and 34. The relay contact 98 is grounded through the armature 94, thus grounding conductor 27 and turning off transistor 64, causing the flip-flop 63 to change states.

When relay coil 80 is energized and armature 82 is connected to the switch contact 87, capacitor 70 discharges to ground through conductors 15 and 16 and resistor 52. This in turn terminates the initial waiting time period and begins the time period in which the apparatus is in the opportunity position.

The second time period, the opportunity time period, begins with the charging of capacitor 72 through resistor 44 from the 24 volt source. When the capacitor 72 charges to the zener voltage of zener diode 76, the base of transistor 62 receives sufficient current to turn on the transistor 62. With the transistor 62 conducting, the base of transistor 64 is pulled down close to ground potential and the transistor 64 accordingly turns off. When the transistor 64 turns off, the flip-flop 63 switches to its other stable state, from the opportunity position back to the wait position.

The charging times of the capacitors 70 and 72 are predetermined or preselected in accordance with the desired time periods in which the apparatus is respectively in the wait position and in the opportunity position. For example, the charging time of capacitor 70 may be selected as 12 minutes, while the charging time of the capacitor 72 may be selected as 3 minutes. Accordingly, after the music box has not been played for a period of 12 minutes, the flip-flop changes states to allow a 3 minute opportunity time period during which a free play may be selected. If a free play is selected during the 3 minute time period, the free play time period is accordingly terminated. After the music box has not been used again for a period of 12 minutes, which is the wait position time period of the apparatus, the 3 minute opportunity period will again be available.

The opportunity time period may be expedited to cut short the waiting time of the apparatus by the manual switch 140. By actuating the manual switch 140, the base of transistor 68 is grounded, thus turning off the transistor and causing the flip-flop to change states. This in turn causes the opportunity time period to begin without waiting for capacitor 70 to charge to the zener voltage of zener diode 75 to turn on transistor 60.

The relay coil 90 is energized when the free play switch 130 is closed, providing transistor 64 is conducting during the opportunity time period. However, when armature 94 is actuated by the coil 90 and switches to relay contact 98, the base of transistor 64 is pulled to near ground potential and it accordingly turns off and the flip-flop 63 changes states.

While relay contact 97 is connected to armature 94, the transistor 69 is turned off because the base of the transistor is grounded through conductor 28, relay contact 97 and armature 94. When the armature 94 switches, current from the 24 volt source through resistor 45 and conductor 18 to the base of the transistor 69 turns the transistor on, thus allowing the relay coil 90 to be energized through conductor 29.

As long as current is sensed on conductors 6 and 7 from a speaker of the music box to which the apparatus is secured, the transistor 66 will be turned on to a conducting state. When no current is sensed by the conductors 6 and 7, the transistor 66 will be turned off to a nonconducting state and the capacitor 70 will begin to charge. When the capacitor 70, which may be referred to as a timing capacitor, charges to a predetermined voltage level, the flip-flop 63 changes states, which, among other things, actuates relay 80. With relay 80 actuated, the capacitor 70 discharges to ground through conductor 16, relay contact 87, and armature 82. When the armature 82 is actuated in response to the actuation of the relay 80, the capacitor 72 begins to charge. When the capacitor 72 reaches a predetermined voltage level, transistor 62 is turned on and the flip-flop 63 again changes states.

During the charging time period of capacitor 72, the free play switch 130 may be actuated and, if it is actuated, the flip-flop 63 will also change states. After the expiration of the "free play" timing period, another "free play" timing period will not begin until after the expiration of another waiting period, which is the timing out period of the capacitor 70.

If the music box device is actuated by a coin while capacitor 70 is charging, the sensing of the current on conductors 6 and 7 will turn on transistor 66 which will cause capacitor 70 to discharge to ground. Accordingly, a full time period must elapse after the music box device is actuated either by a coin or manually by a free play before another free play is available.

The disclosed apparatus is relatively inexpensive, easily maintained, and lends itself to concise packaging. Moreover, a minimum of mechanical, moving components is used, while maximum use is made of solid state circuitry and components.

What is claimed is:

1. Apparatus for providing a free play in a coin operated device, comprising, in combination:

sensing means for sensing a current in the coin operated device for determining when the coin operated device is in use;

first timing means responsive to the sensing means for timing a first predetermined time period;

a multivibrator having a first stable state and a second stable state, and responsive to the sensing means, to the switch means, and to a second timing means to cause the multivibrator to go to its first stable state, and responsive to the first timing means to cause the multivibrator to go to its second stable state;

second timing means responsive to the multivibrator for timing a second predetermined time period after the first predetermined time period;

switch means actuable during the second predetermined time period for selecting a free play in the coin operated device; and voltage means to provide a source of current for the first timing means, the second timing means, and the switch means.

2. The apparatus of claim 1 in which the first timing means includes a first transistor turned off from a conducting state when no current is sensed by the sensing means, and a capacitor connected to the first transistor to charge to a predetermined voltage when the first transistor turns off.

3. The apparatus of claim 2 in which the second timing means includes a first relay actuable in response to the multivibrator going to its second stable state, and a second capacitor connected to the multivibrator to charge to a predetermined voltage when the multivibrator goes to its second stable state.

4. The apparatus of claim 3 in which the first timing means further includes a first zener diode connected to the first capacitor and to the multivibrator to cause the multivibrator to change to its second stable state when the first capacitor charges to a predetermined voltage.

5. The apparatus of claim 4 in which the second timing means further includes a second zener diode connected to the second capacitor and to the multivibrator to cause the multivibrator to change to its first stable state when the second capacitor charges to a predetermined voltage.

6. The apparatus of claim 5 in which the switch means includes a second relay actuable in response to actuation of the switch during the second time period to cause the multivibrator to go to its first stable state.

7. The apparatus of claim 6 in which the second timing means includes a switch connected to the multivibrator to cause the multivibrator to change from its first stable state to its second stable state during the first time period.

* * * * *